US011572223B1

(12) United States Patent
Urban

(10) Patent No.: US 11,572,223 B1
(45) Date of Patent: Feb. 7, 2023

(54) CONTAINER FOR AND METHOD OF CONSUMING A LIQUID

(71) Applicant: Joshua J. Urban, Lockport, IL (US)

(72) Inventor: Joshua J. Urban, Lockport, IL (US)

( * ) Notice: Subject to any disclaimer, the term of this patent is extended or adjusted under 35 U.S.C. 154(b) by 0 days.

(21) Appl. No.: 17/494,976

(22) Filed: Oct. 6, 2021

(51) Int. Cl.

| | |
|---|---|
| ***B65D 47/06*** | (2006.01) |
| ***B65D 43/02*** | (2006.01) |
| ***A47G 19/22*** | (2006.01) |
| *B65D 25/28* | (2006.01) |
| *B65D 85/804* | (2006.01) |

(52) U.S. Cl.
CPC ..... *B65D 47/06* (2013.01); *A47G 19/2211* (2013.01); *B65D 43/021* (2013.01); *B65D 25/2811* (2013.01); *B65D 85/8061* (2020.05); *B65D 2543/0049* (2013.01); *B65D 2543/00731* (2013.01); *B65D 2543/00796* (2013.01)

(58) Field of Classification Search
CPC ..... A47G 19/2211; B65D 85/8031
USPC ..... 220/719
See application file for complete search history.

(56) References Cited

U.S. PATENT DOCUMENTS 183,673 A * 10/1876 Horton ..... A47G 19/2211 220/704
384,977 A * 6/1888 Hopkins ..... A47J 36/08 210/469
662,120 A * 11/1900 Hubbard ..... A47G 19/2211 220/704
2,358,600 A * 9/1944 Selten ..... A47G 19/2272 220/719
2,695,732 A * 11/1954 Tupper ..... A47G 19/24 222/480
4,331,255 A * 5/1982 Fournier ..... B65D 51/18 220/270
5,477,979 A * 12/1995 Goessling ..... A47G 19/2272 220/259.3
8,033,420 B2 * 10/2011 Roseblade ..... A47G 19/2211 220/731
8,469,227 B2 * 6/2013 Tripsiznes ..... B65D 51/10 215/21
2007/0240580 A1 * 10/2007 Lusareta ..... B65D 85/812 99/279

* cited by examiner

*Primary Examiner* — John K Fristoe, Jr.
*Assistant Examiner* — Jennifer Castriotta
(74) *Attorney, Agent, or Firm* — Woods, Phillips, Katz, Clark & Mortimer

(57) ABSTRACT

A method for a person to discharge a consumable liquid including the steps of: obtaining a container having a body bounding a volume and an opening in communication with the volume; placing a quantity of the consumable liquid in the volume; and grasping the container and positioning the container so that the consumable liquid within the volume flows through at least a portion of the opening and into the person's mouth. The container has a blocking structure that is configured to allow the consumable liquid to flow to and through the portion of the opening while blocking movement of material, of a predetermined size suspended in the quantity of consumable liquid, into the at least portion of the opening.

13 Claims, 3 Drawing Sheets

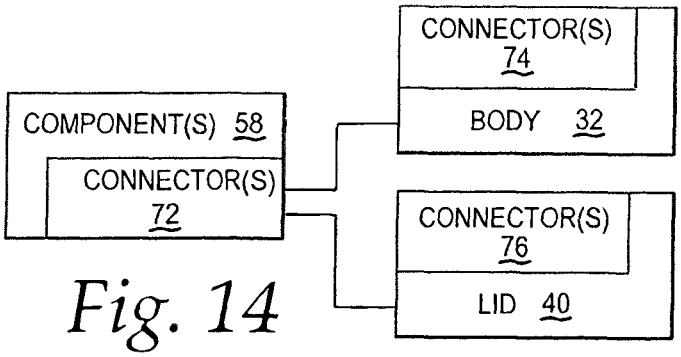
Fig. 14
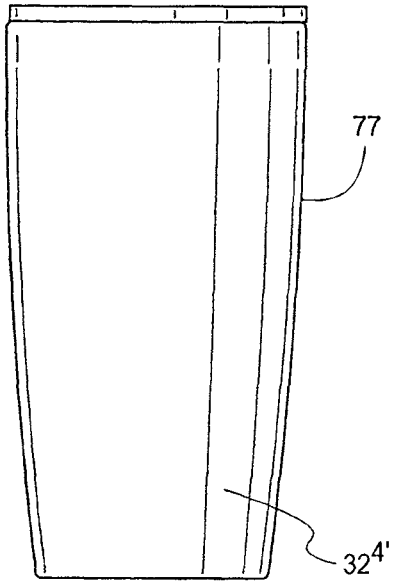
Fig. 15
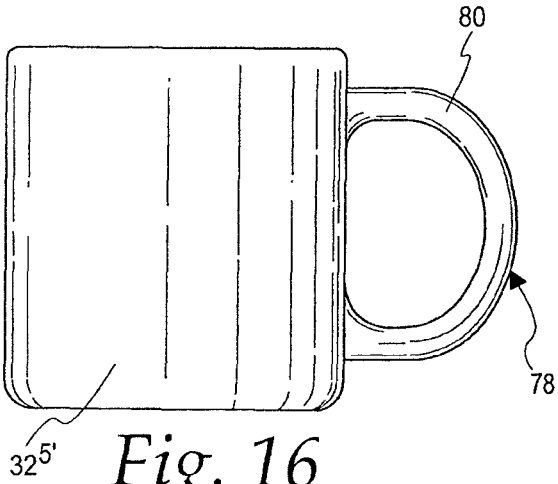
Fig. 16
Fig. 17
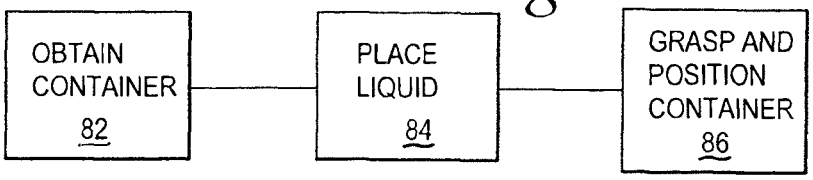
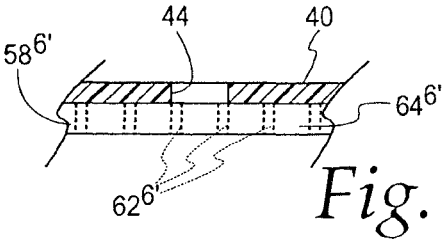
Fig. 18

CONTAINER FOR AND METHOD OF CONSUMING A LIQUID

BACKGROUND OF THE INVENTION

Field of the Invention

This invention relates to a container for consuming liquids and, more particularly, to a container that can be held by a person to allow controlled positioning of the container so that the contained liquid can be controllably discharged therefrom. The invention is also directed to a method of controllably discharging a liquid from the container for consumption.

Background Art

Hand-holdable containers, from which liquids can be discharged for consumption, exist in a multitude of different forms. These containers are commonly categorized as being either reusable or single use.

The worldwide trend has been towards developing reusable forms for both hot and cold liquids. Capacity of these containers varies over a wide range. Handling is facilitated by making a part of the external portion of the container graspable and/or by providing a discrete, graspable handle.

Commonly, a lid is provided on the container to insulate and/or shield the contents and control spillage. The lid typically has a strategically placed opening that, in some forms, can be selectively blocked, to allow discharging of the liquid under gravitational force.

Often, a homogenous liquid form resides within the container, which liquid is unimpeded from flowing smoothly through the lid opening. However, commonly solid materials are placed in the contained beverage and are immersed in the contained liquid volume. For example, a tea bag might be maintained in heated water as it is being discharged/sipped. Liquids may be discharged/sipped while one or more ice masses are immersed in the contained liquid volume.

The solid material creates a problem with gravitational discharge of liquids, with or without an apertured lid. With the container inverted, liquid may be required to flow against and around ice cubes or other solid material. This may create a number of inconveniences.

First of all, the discharging liquid encountering the material may disperse to an unpredictable widened pattern, which may result in spillage. With a discrete aperture, ice cubes, or the like, may partially or fully block flow, which necessitates repositioning of the container and/or breakup of the ice mass at or adjacent to the aperture. Depending upon the size of the ice mass(es), the shaking of the container may cause an unwanted discharge of one or more ice pieces. The ice pieces may also be carried with the discharging liquid and escape from the container, potentially causing the liquid to discharge uncontrollably and necessitating the recovery of the ice pieces.

Heretofore, advances in container technology have been focused on aesthetics, durability, insulation level, etc., without addressing the above problems that have persisted for as long as containers, such as those that are sipped directly at the container rim and/or lid, have existed.

SUMMARY OF THE INVENTION

In one form, the invention is directed to a method for a person to discharge a consumable liquid. The method includes the steps of: obtaining a container having a body bounding a volume and an opening in communication with the volume; placing a quantity of the consumable liquid in the volume; and grasping the container and positioning the container relative to the person's mouth so that the consumable liquid within the volume flows through at least a portion of the opening and into the person's mouth. The step of obtaining a container involves obtaining a container with a blocking structure that is configured to allow the consumable liquid to flow to and through the portion of the opening while blocking movement of material, of a predetermined size suspended in the quantity of consumable liquid, into the at least portion of the opening.

In one form, the step of obtaining a container involves obtaining a container with a lid that is separable from the body and defines, either alone or in conjunction with the body, the opening.

In one form, the step of obtaining a container involves obtaining a container with at least one component with a portion that is spaced from the opening and defines at least a part of the blocking structure.

In one form, the method further includes the step of separating the at least one component from the lid.

In one form, the method further includes the step of separating the at least one component from the body.

In one form, the method further includes the step of separating the at least one component from each of the lid and the body.

In one form, the blocking structure has a screen configuration.

In one form, the body has an external surface that extends around the volume. The step of grasping the container involves grasping the external surface with one hand of the person.

In one form, the body has a discrete handle. The step of grasping the container involves extending the person's hand around a portion of the discrete handle.

In one form, the step of obtaining a container involves obtaining a container wherein at least a part of the blocking structure is separable from at least one of the lid and the body. The method further includes the step of the person's operatively connecting the at least part of the blocking structure to the at least one of the lid and the body.

In one form, the step of operatively connecting the at least part of the blocking structure involves causing a part of the blocking structure to be captively engaged between the lid and the body.

In one form, the step of operatively connecting the at least part of the blocking structure involves releasably connecting the at least part of the blocking structure to one of the lid and the body with the lid and body separated from each other.

In one form, the step of releasably connecting the at least part of the blocking structure involves press fitting the at least part of the blocking structure to the one of the lid and the body.

In one form, there is at least one connector on each of the blocking structure and the one of the lid and body that cooperate to releasably maintain the at least part of the blocking structure on the one of the lid and body.

In one form, the method further includes the step of operatively connecting the lid to the body by press fitting the lid to the body.

In one form, the method further includes the step of operatively connecting the lid to the body by engaging cooperating threads on the lid and the body.

In one form, the blocking structure has a wall with at least one opening through the wall.

In one form, the step of obtaining a container involves obtaining a container with a blocking structure that is configured to block movement of material, of a predetermined size suspended in the quantity of consumable liquid, up to the at least portion of the opening.

In one form, the step of obtaining a container involves obtaining an existing container comprising the body with the opening and retrofitting the blocking structure to the existing container.

In one form, the existing container comprises the body with a separable lid defining the opening.

In one form, the invention is directed to the container as described above.

In one form, the container has a lid that is separable from the body and defines, either alone or in conjunction with the body, the opening.

In one form, the blocking structure has a wall spaced below the opening. There is at least one opening through the wall.

BRIEF DESCRIPTION OF THE DRAWINGS

FIG. 14 is a schematic representation showing connectors cooperating between at least one component on the blocking structure and components on either or both of the body and lid;

FIG. 15 is an elevation view of one exemplary form of body as shown schematically in FIG. 2;

FIG. 16 is a view as in FIG. 15 of an alternative form of body;

FIG. 17 is a flow diagram representation of a method for a person to discharge a consumable liquid according to the invention; and FIG. 18 is a view as in FIG. 6 and showing a modified form of lid and blocking structure.

DETAILED DESCRIPTION OF THE PREFERRED EMBODIMENT

Figure 1:
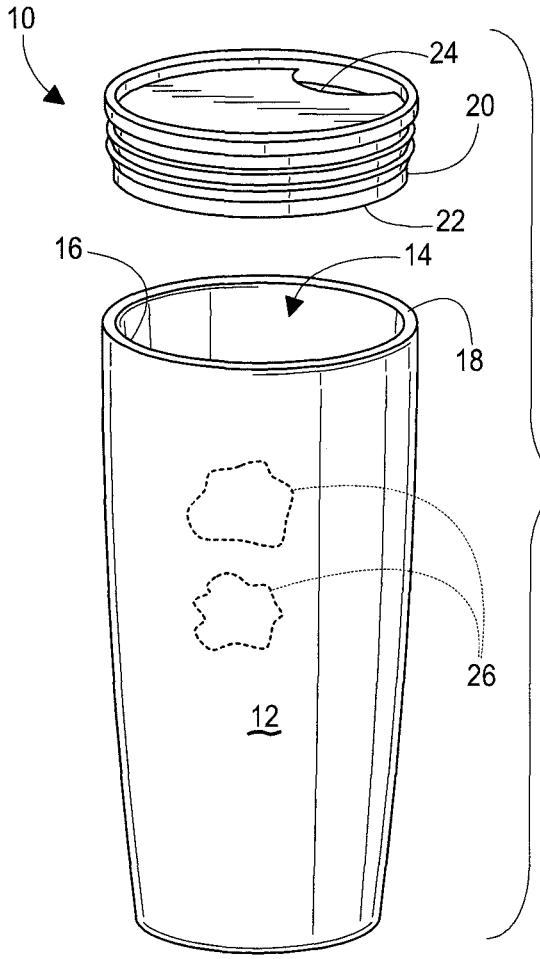
Fig. 1 (PRIOR ART)
FIG. 1 is an exploded perspective view of a prior art container consisting of a body for containing a volume of fluid and a lid with an opening.

In FIG. 1, an exemplary conventional container, usable to discharge a consumable liquid, is shown at 10. The container 10 consists of a cup-shaped body 12 bounding a volume 14 within which a liquid can be placed. The container 10 has an upper opening 16 in communication with the volume 14. A rim 18 surrounds the opening 16.

A lid 20 is releasably engaged with the rim 18. In the depicted form, the lid 20 has a depending skirt 22 that is press fit within the opening 16 to be releasably operably connected to the body 12. The connection is commonly frictionally maintained to establish a sealed annular region that blocks liquid passage between the skirt 22 and the surrounding body 12. With the lid 20 operatively connected, discharge of liquid from the volume 14 is thus limited to passage through an opening 24 formed in the lid 20.

Typically, a person will place a quantity of the consumable liquid within the volume 14 together with a "material" 26 having a generally maintainable shape and size. As depicted, the material 26 is in the form of ice cubes but could be any solid or composition that does not flow freely as a liquid. A tea bag is also a representative material.

A person can use the body 12 with or without the lid 20. In the latter case, the person grasps the body 12 and repositions the same so that the rim 18 is at or adjacent the person's mouth. With a partially inverted orientation for the body 12, liquid within the volume 14 will flow by gravity towards the opening 16 and the person's mouth. Generally, the opening 16 will have a configuration such that the liquid funnels to a flow width that is manageable by the user without concern of uncontrolled dispersion of the liquid. However, the material 26 likewise flows gravitationally towards the opening 16 upon inversion of the body 12. At some degree of inversion, the material 26 moves up to the opening 16 and is prone to escaping from the volume 14 unless confined by the frontal face region of the person consuming the liquid. Thus, the person must be conscious of controlling the location of the material 26 while controlling discharge of the liquid from within the volume 14.

If the lid 20 is placed in an operative position, the opening 24 can be made with an effective diameter that blocks certain of the material 26 from escaping through the opening 24. However, one or more pieces of the material 26 may move up to and into the opening 24 and effect blockage thereof, whereby a smooth controllable discharge of the liquid through the opening 24 is impeded.

Figure 2:
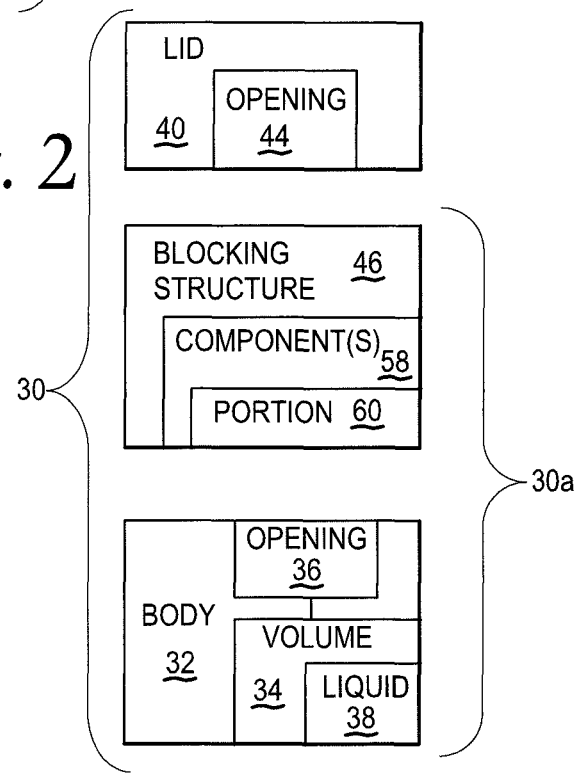
FIG. 2 is a schematic representation of a container, according to the present invention, and including a blocking structure that cooperates with a body to control movement of material within a liquid contained within the body.

An exemplary form of the invention is shown in schematic form in FIG. 2. The generically depicted structure is intended to encompass the components, as in FIG. 1, as well as virtually an unlimited number of variations of those components and their interaction.

The inventive container 30 depicted in FIG. 2 consists of a body 32 bounding a volume 34 and having an opening 36 in communication with the volume 34. The volume 34 contains a quantity of consumable liquid 38.

The container further has a lid 40 that is connectable to the body 32 and has an opening 44 therein.

The container 30 further includes a blocking structure 46 that is configured: a) to allow liquid 38 to be directed through the opening 36 and through at least a portion of the opening 44 into the person's mouth; and b) while blocking movement of material 26, of a predetermined size suspended in the quantity of liquid 38 within the volume 34, up to and into the at least portion of the opening 44.

Figure 3:
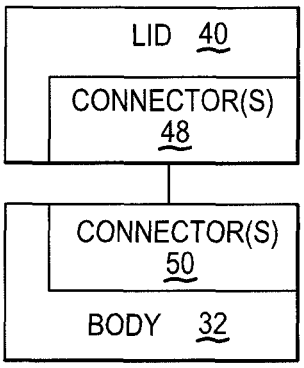
FIG. 3 is a schematic representation of a connection between the lid and body on the container in FIG. 2.

The lid 40 may be connected to the body 32 through a multitude of different connecting arrangements, any of which might be utilized. As depicted schematically in FIG. 3, the lid 40 may have at least one connector 48 that cooperates with at least one connector 50 on the body 32. The connectors 48, 50 may be simply surfaces formed on the lid 40 and body 32 that frictionally engage. Threaded connections might be used. Virtually any type of connector configuration is contemplated, preferably to allow selective separation of the lid 40 from the body 32.

In FIG. 2, an alternative container 30*a* is shown wherein the lid 40 is omitted and the blocking structure 46 performs the functions as described above, including certain functions performed by the lid 40. The blocking structure 46 may have one or more separate openings or may cooperate with the body 32 to produce one or more openings in conjunction therewith.

Figure 4:
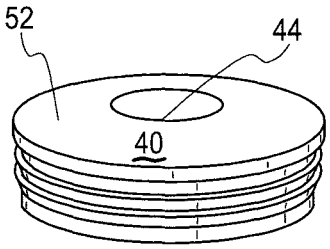
FIG. 4 is a perspective view of one exemplary form of lid, as shown schematically in FIG. 2, with a fully surrounded opening.

As shown in FIG. 4, one exemplary form of the lid 40 has the opening 44 fully surrounded by a wall 52 on the lid.

Figure 5:
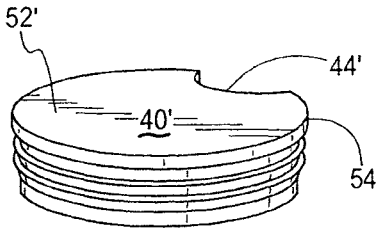
FIG. 5 is a view as in FIG. 4 of a modified form of lid wherein an opening is defined cooperatively by the lid and a body to which the lid is operatively connected.

Alternatively, as shown in FIG. 5, the lid 40' has an opening 44' that is formed through a peripheral skirt 54, depending from a wall 52', whereby the opening 44' is bounded in part by the wall 52' and in part by the associated container (not shown in FIG. 5).

As shown in FIG. 2, the blocking structure 46 consists of at least one component 58 with a portion 60 that is at, or more preferably spaced from, the opening 44 on the container 30 and the opening 36 on the container 30*a*.

Figure 6:
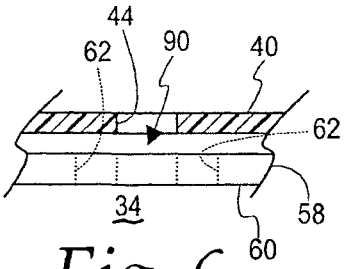
FIG. 6 is a fragmentary, partially schematic, cross-sectional view of one form of lid and blocking structure, as shown schematically in FIG. 2.

In one form, shown partially schematically in FIG. 6, the component 58 has a portion/wall 60 spaced beneath the lid opening 44 to block passage of material 26 from the volume 34 up to the opening 44. The portion/wall 60 has multiple screen openings 62 to allow flow of liquid from the volume 34 past the portion/wall 60 up to and through the opening 44.

Figure 7:
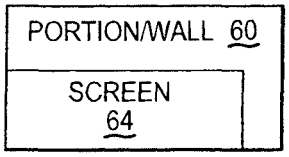
FIG. 7 is a schematic representation of a component on the blocking structure through which liquid can flow.

While the flow of liquid from the volume 34 past the portion/wall 60 to the opening 44 in FIG. 6 is made possible by the provision of openings 62, there is no limitation as to the number or configuration of the openings 62. In one preferred form as shown schematically in FIG. 7, the portion/wall 60 has a configuration as in the form of a screen 64. The screen 64 may be flexible or rigid in nature in all forms herein.

Figure 8:
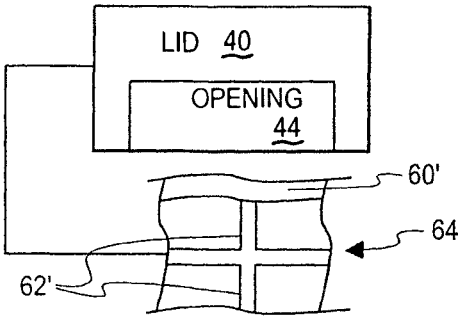
FIG. 8 is a partially schematic, fragmentary representation of one form of component as shown schematically in FIG. 7.

As shown in FIG. 8, one exemplary, but not limiting, form of the screen 64 is depicted with a portion/wall 60' with openings 62' arranged in a grid pattern. In this particular form, the portion/wall 60' is shown connected to the lid 40 with the opening 44.

Figure 9:
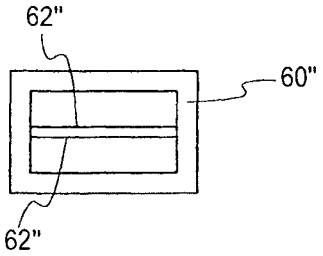
FIG. 9 is a view similar to that in FIG. 8 and showing an alternative form of the component on the blocking structure.

In an alternative form, as shown in FIG. 9, the portion/wall 60" has slit-type openings 62" that produce another screen configuration.

Again, there is no limitation as to the nature of the opening(s) in the particular portion/wall 60.

Figure 10:
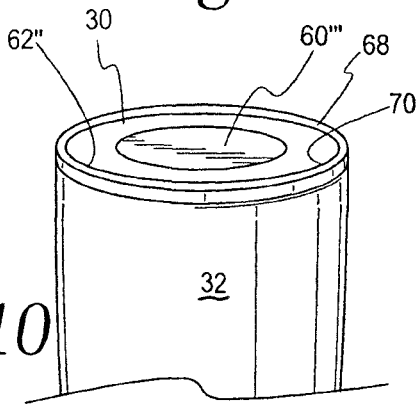
FIG. 10 is a fragmentary, perspective view of another form of container, according to the present invention, wherein a blocking structure cooperates with a body on the container to define a liquid opening.

In an alternative form, the portion/wall 60" in FIG. 10 is positioned relative to the body 32 so that an annular opening 62" is formed around the portion/wall 60'" and is actually formed cooperatively by the body and portion/wall 60'". The radial dimension of the opening 62" can be controlled to limit passage of a particular size of material 26.

With the lid 40 used on the container 32 in FIG. 10, the portion/wall 60'" is spaced from the lid opening to define a volume within which liquid can flow to ultimately pass through the lid opening without blockage by any material 26, which is intercepted by the portion/wall 60'".

Alternatively, with a lid omitted from the container 32 in FIG. 10, the portion/wall 60'" may be set at, and more preferably below, the top of the rim 68 which bounds the body opening 70.

Figure 11:
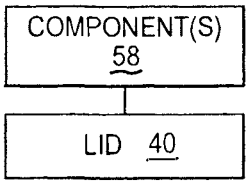
FIG. 11 is a schematic representation showing at least one component on the blocking structure as in FIG. 2 connected to the lid.

As shown schematically in FIG. 11, the component(s) 58 may be connected permanently or releasably to the lid 40.

Figure 12:
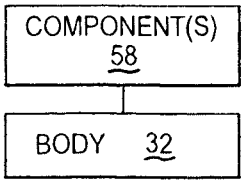
FIG. 12 is a view as in FIG. 11 wherein the component(s) are connected to the container body.

Alternatively, the component(s) 58 may be permanently or releasably connected to the body 32, as shown schematically in FIG. 12.

Figure 13:
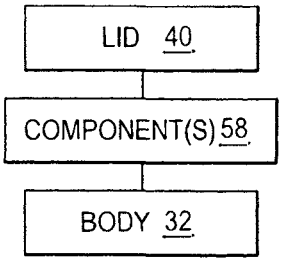
FIG. 13 is a schematic representation wherein at least one component on the blocking structure is maintained between the lid and body.

As further shown in FIG. 13, the component(s) 58 may be located between parts of the lid 40 and the body 32 preferably but not necessarily in a captive arrangement.

As shown in FIG. 14, the component(s) 58 has at least one connector 72 that cooperates with at least one connector 74 on the body 32 and/or at least one connector 76 on the lid 40.

As noted above, the connections between the component (s) 58 and the lid 40 and/or body 32 may be permanent or releasable. A releasable connection allows the component(s) 58 to be independently accessed as to facilitate cleaning.

The connectors 72, 74, 76 are not limited in form. As one example, the cooperating connectors may be cooperating frictionally engaged surfaces. As another example, the connectors 72, 74, 76 may include discrete parts that engage, as by press or snap fitting together. An adhesive might be employed. Releasable or permanent connection is contemplated.

As shown in FIG. 15, an exemplary body $\mathbf{32}^{4'}$ has a tapered cylindrical shape with an external surface 77 extending around the internal containment volume. The surface 77 has a diameter that is dimensioned to be graspable by a hand of a person.

Alternatively, as shown in FIG. 16, the body $\mathbf{32}^{5'}$ has a discrete handle 78 with a portion 80 which a person can extend his/her hand around to effect grasping thereof to control positioning of the body $\mathbf{32}^{5'}$.

With the structures as described above, a person can discharge a consumable liquid by practicing a method as set forth in flow diagram form in FIG. 15.

As shown at block 82, a person obtains a container as described above.

As shown at block 84, a quantity of consumable liquid is placed in the volume of the container.

As shown at block 86, the container is grasped and positioned relative to the person's mouth so that the consumable liquid within the volume flows through at least a portion of the opening on the lid and/or body and into the person's mouth.

As this occurs, the blocking structure allows the liquid to flow to discharge while blocking movement of any material of a predetermined size, suspended in the quantity of consumable liquid, up to or into at least a portion of the opening through which the liquid discharges.

Consequently, with the blocking structure spaced from the opening 44, the blocking structure effectively creates a fillable sub-volume, shown in an exemplary form at 90 in FIG. 6, within which liquid from the volume 34 flows and prevents material from getting into the sub-volume 86 as might impede flow through the opening 44 or altogether block flow passage. Preferably adequate provision is made to allow flow of liquid to the sub-volume 86 that a smooth flow of liquid occurs as the entire volume of liquid is discharged from the body volume.

Alternatively, as shown in FIG. 18, the component $\mathbf{58}^{6'}$ has a portion/wall $\mathbf{64}^{6'}$ with screen openings $\mathbf{62}^{6'}$ with the wall extending up to the opening 44 in the exemplary lid 40.

It is further contemplated that the blocking structure might extend into the lid opening.

The container may be constructed, as by manufacturers, to include the blocking structure. Alternatively, the container may be an existing product that is modified to add the blocking structure. This retrofitting process may be to a container without a lid or a container including a lid defining the opening in communication with the volume bounded by the container body.

As noted above, the blocking structure component(s) 58 may be permanently connected to the lid 40 or releasably connected thereto whereby separation can be carried out for cleaning.

Likewise, in the event that the at least one component 58 is maintained in an operative position on the body 32, this connection may be permanent or separable, which allows access for thorough cleaning.

The entire blocking structure 46 may be separated from its respective lid or body or alternatively, a part thereof, such as the component(s) 58 may be separated while maintaining other portions of the blocking structure 46 permanently attached to its respective lid 40 or body 32.

Thus, the person using the container may conveniently separately wash part or all of the blocking structure 46 and effect reconnection for reuse.

As noted above, part or all of the blocking structure 46 can be connected by a press fitting arrangement, a snap fitting arrangement, or any other arrangement whereby cooperating connectors engage by being either frictionally held, reconfigured, etc.

The foregoing disclosure of specific embodiments is intended to be illustrative of the broad concepts comprehended by the invention.

The invention claimed is:

1. A method for a person to discharge a consumable liquid comprising the steps of:

obtaining a container comprising a body bounding a volume, with a quantity of consumable liquid in the volume, and an opening in communication with the volume wherein the step of obtaining a container further comprises obtaining a container with a blocking structure that is configured to allow the consumable liquid to flow to and through at least a portion of the opening while blocking movement of material, of a predetermined size, suspended in the quantity of consumable liquid, into the at least portion of the opening, wherein the step of obtaining a container further comprises obtaining a container with a lid that is separable from the body and defines, either alone or in conjunction with the body, a second opening that is at least partially formed by a wall on the lid, wherein the step of obtaining a container further comprises obtaining a container with at least one component defining at least a part of the blocking structure and that is separable from the lid, wherein the at least one component has a wall with a screen configuration with screen openings extending through a surface region of the wall on the at least one component, wherein the second opening extends through a surface region on the lid wall, wherein the screen openings through the surface region of the wall on the at least one component extend up to and align with the second opening; and grasping the container and positioning the container relative to the person's mouth so that the consumable liquid within the volume flows through the screen openings and the second opening and into the person's mouth.

2. The method for a person to discharge a consumable liquid according to claim 1 further comprising the step of separating the at least one component from the body.

3. The method for a person to discharge a consumable liquid according to claim 1 wherein the body has an external surface extending around the volume and the step of grasping the container further comprises grasping the external surface with one hand of the person.

4. The method for a person to discharge a consumable liquid according to claim 1 wherein the body has a discrete handle and the step of grasping the container further comprises extending the person's hand around a portion of the discrete handle.

5. The method for a person to discharge a consumable liquid according to claim 1 further comprising the step of operatively connecting the at least one component by causing a part of the blocking structure to be captively engaged between the lid and the body.

6. The method for a person to discharge a consumable liquid according to claim 1 further comprising the step of operatively connecting the at least one component to at least one of the lid and the body with the lid and body separated from each other.

7. The method for a person to discharge a consumable liquid according to claim 6 wherein the step of operatively connecting the at least one component further comprises press fitting the at least one component to the at least one of the lid and the body.

8. The method for a person to discharge a consumable liquid according to claim 6 wherein there is at least one connector on each of the blocking structure and the at least one of the lid and body that cooperate to releasably maintain the at least one component on the at least one of the lid and body.

9. The method for a person to discharge a consumable liquid according to claim 1 further comprising the step of operatively connecting the lid to the body by press fitting the lid to the body.

10. The method for a person to discharge a consumable liquid according to claim 1 further comprising the step of operatively connecting the lid to the body by engaging cooperating threads on the lid and the body.

11. The method for a person to discharge a consumable liquid according to claim 1 wherein the step of obtaining a container further comprises obtaining an existing container comprising the body with the container opening and retrofitting the blocking structure to the existing container.

12. The method for a person to discharge a consumable liquid according to claim 11 wherein the existing container comprises the body with the lid that is separable from the body.

13. The container as recited in claim 1.

* * * * *